United States Patent [19]

Specker et al.

[11] Patent Number: 4,908,269

[45] Date of Patent: Mar. 13, 1990

[54] CRIMPED POLYESTER-YARN FROM COLD DRAWN POLYESTER-POY-YARN AND PROCESS FOR ITS MANUFACTURE

[75] Inventors: Hugo Specker, Sempach; Paul Schaffner, Kriens, both of Switzerland

[73] Assignee: Viscosuisse S.A., Emmenbrucke, Switzerland

[21] Appl. No.: 642,919

[22] PCT Filed: Dec. 8, 1983

[86] PCT No.: PCT/CH83/00138

§ 371 Date: Aug. 9, 1984

§ 102(e) Date: Aug. 9, 1984

[87] PCT Pub. No.: WO84/02357

PCT Pub. Date: Jun. 21, 1984

[30] Foreign Application Priority Data

Dec. 17, 1982 [CH] Switzerland ..... 7354/82

[51] Int. Cl.[4] ..... D02G 3/00

[52] U.S. Cl. ..... 428/369; 428/362; 428/364

[58] Field of Search ..... 57/246; 428/369, 362, 428/364, 371; 264/210.7, 210.8, 176 F, 168

[56] References Cited

U.S. PATENT DOCUMENTS

| | | | |
|---|---|---|---|
| 2,758,908 | 8/1956 | Kolb . | |
| 3,680,301 | 8/1972 | Michel | 57/246 |
| 3,691,748 | 9/1972 | Buzano | 57/246 |
| 3,816,992 | 6/1974 | Frankfort et al. | 57/246 |
| 3,953,962 | 5/1976 | Breen | 57/246 |
| 4,414,169 | 11/1983 | McClary | 264/210.7 |

FOREIGN PATENT DOCUMENTS

| | | |
|---|---|---|
| 941010 | 7/1949 | Fed. Rep. of Germany . |
| 58-76516 | 5/1983 | Japan . |
| 1061774 | 3/1967 | United Kingdom . |

*Primary Examiner*—Lorraine T. Kendell

*Attorney, Agent, or Firm*—Seidel, Gonda, Lavorgna & Monaco

[57] ABSTRACT

The invention concerns a crimped Polyester-yarn obtained from cold drawn Polyester-POY as well as a process for its manufacture.

For this yarn the stress/strain course between 10 and 30% elongation resulting from the stretch test corresponds to a secant modul of 0–100%. Application in the knitting, weaving and warp knitting.

5 Claims, 4 Drawing Sheets

CRIMPED POLYESTER-YARN FROM COLD DRAWN POLYESTER-POY-YARN AND PROCESS FOR ITS MANUFACTURE

The invention concerns a crimped Polyester-yarn obtained from cold drawn Polyester-POY as well as a process for its manufacture and the application of such yarns.

The DE-AS No. 12 91 852 concerns a process for the manufacture of fibres, yarns or films from crystallizable Polyester, by slow melt spinning, subsequently warm drawing and after that thermal shrinkage of the yarns or films. The thus obtained fibres, yarns of films may be irreversible lengthened by moderate heat treatment, without that a tension is exercised on them, and they no more return on their original length by cooling and drying.

The cold drawing of Polyester-POY (=Partially Oriented Yarn) is not very spread. But nevertheless it is known: TEIJIN mentions in the Japanese Application No. 0 055 268 of 16.5.77 the cold drawing in a draw ratio of 1.05–1.35 of a Polyester yarn spun between 4000 and 7000 m/min. The literature does not mention the possibility of aftertreatment of such yarns. The present invention concerns a new yarn, which is manufactured by an aftertreatment of a cold drawn Polyester-POY.

The invention concerns a crimped Polyester-yarn, obtained from cold drawn Polyester-POY-yarn, characterised in that the stress/strain course between 10 and 30% elongation resulting from the stretch test corresponds to a secant modulus of 0–100%.

We designate as secant modulus the end value of a straight line, defined by the stress by 10 and 30% elongation, parallel shifted on stress 0 by elongation 0. The unity corresponds to the percentage portion of the breaking stress by 100% theoretical elongation.

Figure 1:
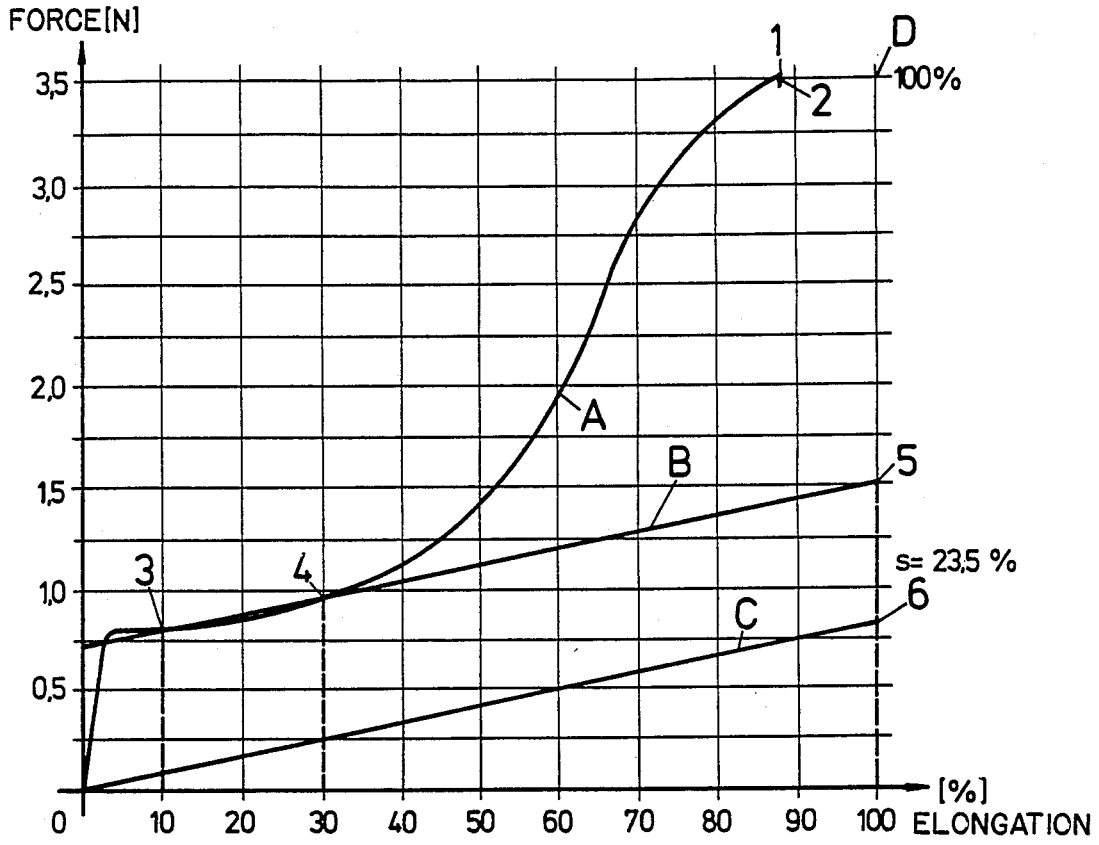

Hereafter the definition of the secant modulus will be precisely explained in relation with FIG. 1. It is already possible to mention, that the stress/strain diagram shows a marked plateau zone, which characterises the yarn according to the invention.

These yarns are twistless and totally shrunked. The crimp is three dimensional, optically interesting and presents a fine appearance. The crimp of the individual fibrils is irregular.

If here one speaks of Polyester-POY, endless yarns are concerned, which are spun between 2000 and 5000 m/min. The cold drawing takes place at room temperature on a draw machine, for example a drawtwist- or draw-wind machine, with a draw ratio of 1.2 to 2.2. The denier of the individual filaments is not critical.

The invention further concerns a process for the manufacture of the above mentioned crimped yarns, by which cold drawn Polyester-POY-yarns are subjected to a thermal treatment. The thermal treatment is carried out in the air, vapour or inert liquid. One understands under inert liquid, a liquid, in which Polyester does not dissolve, and which does not react with the Polyester. Water is preferred as such a liquid. The yarn simultaneously shrinks very largely (up to 60%) by the treatment.

The shrinkage force of the cold drawn Polyester-POY-yarn nevertheless is very small, so that already smallest stresses could reduce or even prevent the shrinkage. The thermal treatment is therefore carried out tensionless or under controlled overfeed. The overfeed varies between 20 and 100%, preferably between 40 and 80%.

The thermal treatment preferably takes place in a shocking way. Under shocking way treatment one understands here a sudden, short-term warming up of the yarn or by wet treatment a bringing in of the article in the warmed-up bath.

One works in the air at a temperature of more than 80° C., preferably between 140° and 220° C., continuously, under controlled overfeed of 20–100%, preferably of 40–80%. A convection heater is advantageously used for the thermal treatment of the yarn.

If the thermal treatment is carried out in steam or inert liquid, it occurs at a temperature of more than 60° C., preferably at 90°–100° C., tensionless, respectively with a controlled overfeed of 20–100%, preferably of 40–80%. Steam means saturated steam or overheated water steam.

The crimp of the yarn according to the invention is irregular and stress sensitive. The further processing of the yarn should therefore be carried out under a stress smaller than about 0.5 cN/dtex. This is possible or normally the case with all present knitting-, weaving- and warp knitting machines.

The invention further concerns the application of the crimped yarn in the knitting, weaving and warp knitting.

Figure 2:
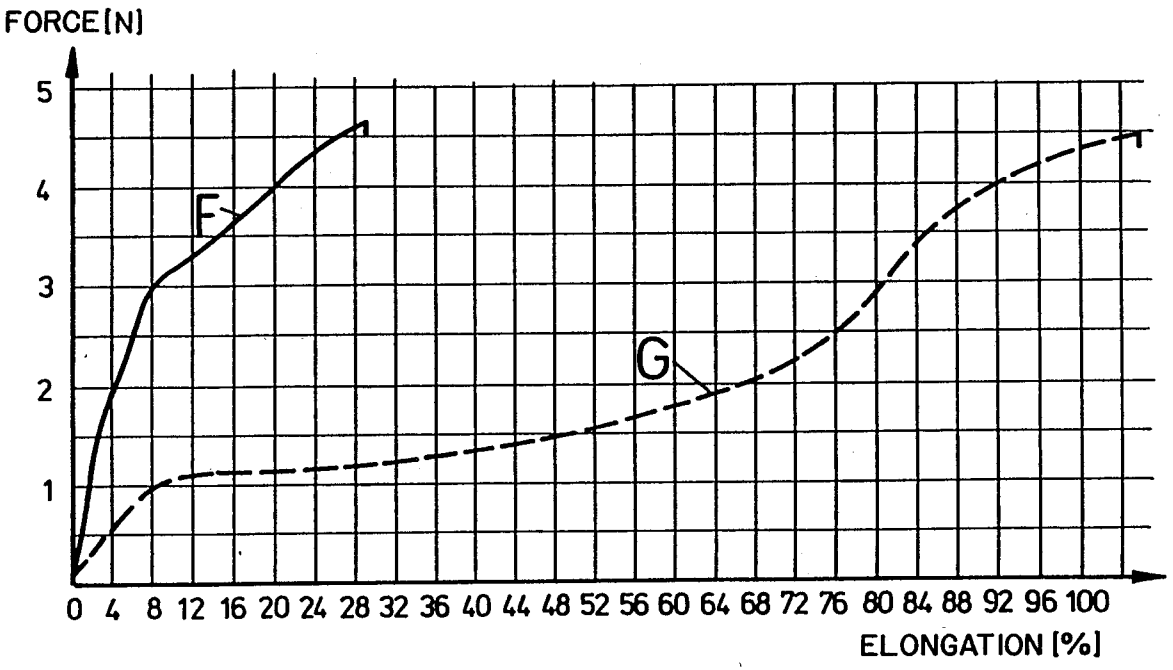
Figure 3:
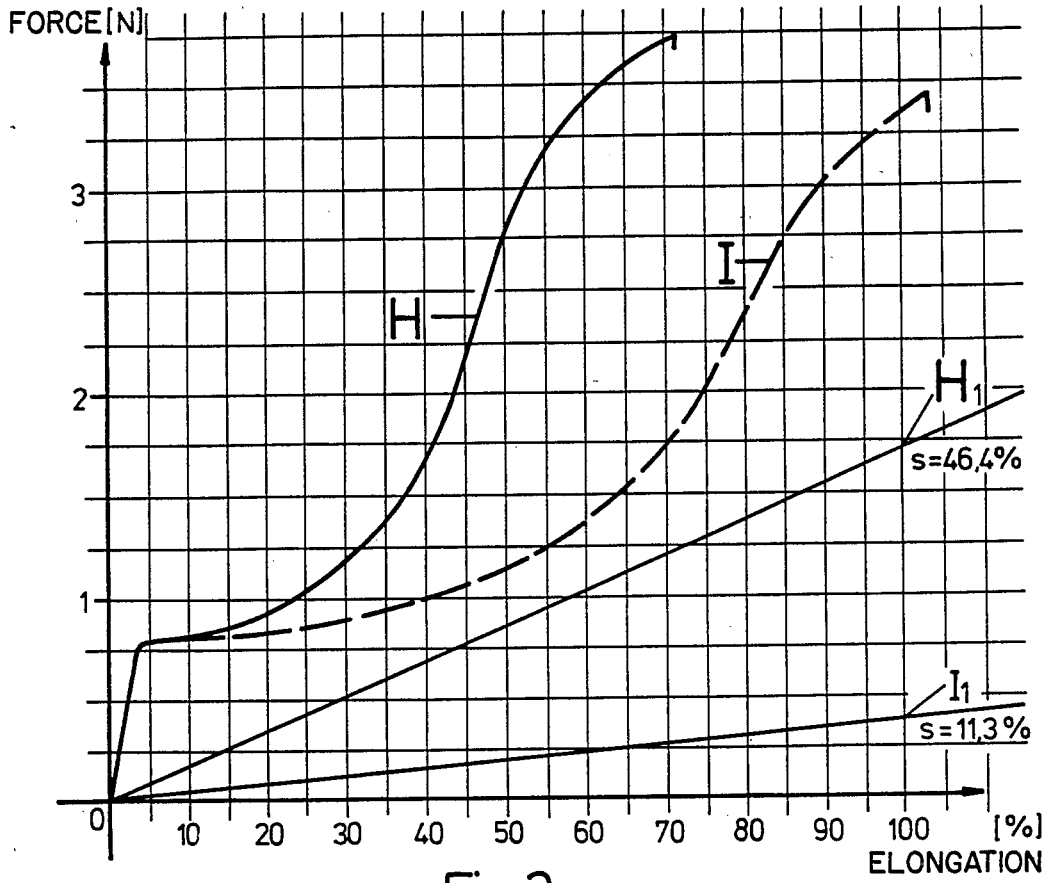
Figure 4A:
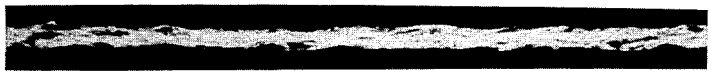
Figure 4B:
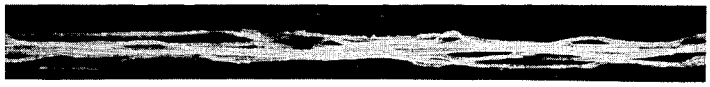
Figure 4C:
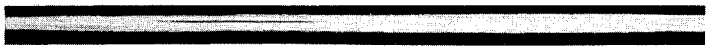
Figure 5:
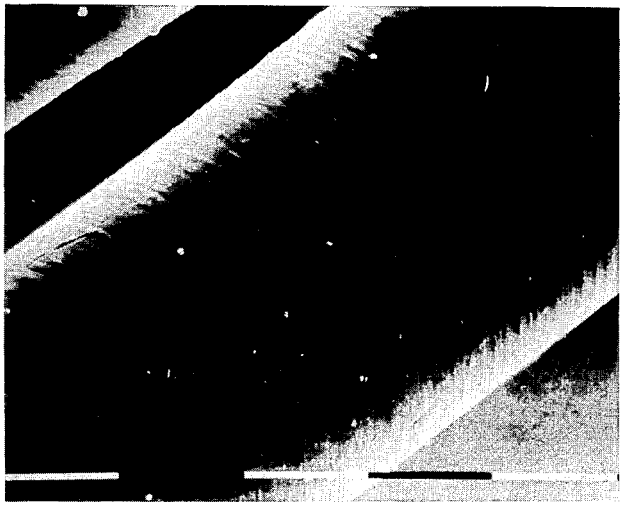

The invention is precisely explained in relation to the joined figures, which show FIG. 1 the stress/strain diagram of a yarn according to the invention, as well as the representation of the secant modulus, FIG. 2 the stress/strain diagram of the raw material and of the yarn according to the invention, FIG. 3 the stress/strain diagram of yarns, which were treated under different overfeed, FIG. 4 a yarn according to the invention beside a false twist textured and a flat yarn, and FIG. 5 the characteristic surface structure of the yarn according to the invention.

FIG. 1 shows a stress/strain diagram A of a Polyester yarn according to the invention, half mat, round, tested according to DIN 53834, first part. Point 1 gives the breaking stress in Newton, and point 2 the breaking elongation in %. The yarn is characterised by this plateau zone between the points 3 and 4. Defined by point 3 (elongation 10%) and point 4 (elongation 30%), a straight line B is drawn, limited by elongation 0 and theoretical elongation 100% (point 5). In order to calculate the secant modulus according to the invention, the straight line B is parallel shifted on stress 0 by elongation 0. Then, the straight line C results with secant modulus point 6 by 100% elongation. The thus obtained stress by 100% theoretical elongation is calculated as part expressed as percentage of the effective breaking stress (point D), in our example s=23.5%.

FIG. 2 shows the curve F of the stress/strain diagram of a cold-drawn Polyester-POY-yarn and the curve G that of a thermal treated yarn. The treatment took place in a shocking way, tensionless in warm water.

FIG. 3 shows the stress/strain diagram H and I of the Polyester yarns according to the invention, which were thermally treated by 40 respectively 80% overfeed. Both tests took place with Polyester yarns, half mat, round (denier of the cold drawn Polyester-POY dtex 84 f 15) at a temperature of 200° C. As heat device served the convection heater of a fixing respectively poststabilizing machine. The speed was at 110 m/min. The points $H_1$ and $I_1$ give a value of the secant modul s=46.4% respectively s=11.3%.

FIG. 4*b* shows a yarn according to the invention, FIG. 4*a* a false twist textured Polyester yarn and FIG. 4*c* a flat yarn. The irregularity of the crimp of the individual fibrils is clear evident from FIG. 4*b*.

FIG. 5 shows a Scanning-Electronic-Microscope photo with a magnification of 2100:1. On this photo, the typical transverse lines according to the process are clear obvious.

The invention is precisely explained in relation to the examples.

EXAMPLE 1

(three steps process)

Polyester-POY dtex 150 f 15 was manufactured at a speed of 3100 m/Min. The drawing took place with a ratio of 1:1.93 at 652 m/min at room temperature on a drawtwist-machine.

Subsequently the bobbins were shrunk in a shocking way on a fixing- respectively poststabilizing machine in the convection heater (heat length 63 cm) at 200° C. The withdrawal speed was at 110 m/min. The delivery speed varied between 154 m/min (corresponding to 40 % overfeed, respectively 28.6% shrinkage, FIG. 3 H) and 198 m/min (corresponding to 80% overfeed, respectively 44.4% shrinkage, FIG. 3 I). The properties of the yarn according to the invention are mentioned in table 1.

TABLE 1

| | 40% overfeed | 80% overfeed |
|---|---|---|
| secant modulus S (%) | 46,4 ($H_1$) | 11,3 ($I_1$) |
| breaking stress (N) | 3,7 | 3,4 |
| breaking elongation (%) | 72 | 107 |
| boiling shrinkage at 98° C. (%) | 0,2 | +1,8 |
| hot shrinkage at 160° C. (%) | +4,3 | +11,0 |

+ = extension

EXAMPLE 2

(two steps process)

Polyester-POY dtex 170 f 36 was manufactured at a speed of 3100 m/min. These bobbins were continuously cold drawn and shrinked in a shocking way. The manufacturing conditions are mentioned in table 2.

TABLE 2

| | Variant A | Variant B |
|---|---|---|
| entering in the draw-zone | 91 m/min | 229 m/min |
| draw-ratio | 1:1.75 | 1:1.75 |
| withdrawal | 160 m/min | 400 m/min |
| convection heater: | | |
| temperature of the shrinking zone | 220° C. | 220° C. |
| length of the heater | 1,20 m | 1,20 m |
| overfeed/shrinkage | 60%/37,5% | 60%/37,5% |
| winding | 100 m/min | 250 m/min |

The properties of the yarn according to the invention are mentioned in table 3.

TABLE 3

| | Variant A | Variant B |
|---|---|---|
| secant modulus S (%) | 65,6 | 23,3 |
| breaking stress (N) | 3,2 | 3,9 |
| breaking elongation (%) | 67 | 92 |
| boiling shrinkage at 98° C. (%) | 1,2 | +2 |
| hot shrinkage at 160° C. (%) | +1,5 | +9 |

+ = extension

The yarns according to the invention are directly used in the knitting, weaving and warp knitting or are twisted and/or sized for example for weaving warp use.

We claim:

1. Crimped polyester yarn obtained from cold drawn partially-oriented polyester yarn, said crimped polyester yarn having a secant modulus of 0–100% as determined by the stress versus strain curve for said crimped polyester yarn between 10% and 30% elongation.

2. Crimped polyester yarn according to claim 1 wherein individual fibrils of said yarn have an irregular crimp.

3. Crimped polyester yarn according to claims 1 or 2 which is twistless.

4. Crimped polyester yarn according to claims 1 or 2 which is shrunk up to 60% of its unshrunk length.

5. Crimped polyester yarn according to claim 3 which is shrunk up to 60% of its unshrunk length.

* * * * *